US008813445B2

(12) United States Patent
Kim

(10) Patent No.: US 8,813,445 B2
(45) Date of Patent: Aug. 26, 2014

(54) SUPPORT BEAM STRUCTURE CAPABLE OF EXTENDING SPAN AND REDUCING HEIGHT OF CEILING STRUCTURE AND INSTALLING METHOD THEREOF

(76) Inventor: Choong-Ki Kim, Seoul (KR)

( * ) Notice: Subject to any disclaimer, the term of this patent is extended or adjusted under 35 U.S.C. 154(b) by 80 days.

(21) Appl. No.: 13/233,274

(22) Filed: Sep. 15, 2011

(65) Prior Publication Data

US 2012/0079782 A1 Apr. 5, 2012

(30) Foreign Application Priority Data

Sep. 30, 2010 (KR) ..... 10-2010-0095403

(51) Int. Cl.

| | |
|---|---|
| ***E04C 2/52*** | (2006.01) |
| ***E04C 3/00*** | (2006.01) |
| ***E04B 5/10*** | (2006.01) |
| ***E04H 12/00*** | (2006.01) |
| ***E04B 1/16*** | (2006.01) |

(52) U.S. Cl.

USPC ..... 52/220.1; 52/836; 52/837; 52/838; 52/839; 52/840; 52/842; 52/843; 52/647; 52/649.1; 52/649.2; 52/331; 52/340

(58) Field of Classification Search

USPC ..... 52/836–845, 647, 648.1, 649.1, 649.2, 52/319–321, 331, 333–336, 338, 340, 341

See application file for complete search history.

(56) References Cited

U.S. PATENT DOCUMENTS

| | | | | | |
|---|---|---|---|---|---|
| 138,029 | A | * | 4/1873 | Kirkup | 52/838 |
| 523,075 | A | * | 7/1894 | Krause | 52/838 |
| 1,014,157 | A | * | 1/1912 | Lewen | 52/326 |
| 1,086,343 | A | * | 2/1914 | Anderson | 249/25 |
| 1,484,649 | A | * | 2/1924 | Johnson | 52/766 |
| 1,595,222 | A | * | 8/1926 | Butterworth | 52/647 |
| 1,772,358 | A | * | 8/1930 | McIntyre | 52/690 |
| 1,858,836 | A | * | 5/1932 | Martell | 52/647 |
| 1,976,595 | A | * | 10/1934 | Asleson et al. | 248/228.1 |
| 2,082,960 | A | * | 6/1937 | Kinninger et al. | 52/647 |
| 2,125,691 | A | * | 8/1938 | Ragsdale et al. | 52/839 |
| 2,164,137 | A | * | 6/1939 | London | 52/330 |
| RE21,921 | E | * | 10/1941 | Greulich | 52/327 |
| 2,665,578 | A | * | 1/1954 | Hillberg | 52/647 |
| 3,131,656 | A | * | 5/1964 | Houle | 108/51.3 |
| 3,280,530 | A | * | 10/1966 | Rothenbach | 52/838 |
| 3,300,940 | A | * | 1/1967 | Golasz | 52/843 |
| 3,579,937 | A | * | 5/1971 | Lukens | 52/309.8 |
| 3,596,421 | A | * | 8/1971 | Miller | 52/333 |
| 3,602,158 | A | * | 8/1971 | Skaggs | 108/51.3 |
| 3,619,959 | A | * | 11/1971 | Parker | 52/223.6 |
| 4,571,913 | A | * | 2/1986 | Schleich et al. | 52/649.2 |
| 4,584,815 | A | * | 4/1986 | Haven et al. | 52/327 |

(Continued)

*Primary Examiner* — Brian Glessner
*Assistant Examiner* — Omar Hijaz
(74) *Attorney, Agent, or Firm* — Kratz, Quintos & Hanson, LLP

(57) ABSTRACT

Disclosed are a support beam structure capable of extending a span and reducing a height of a ceiling structure and an installing method thereof. The support beam structure includes an H-beam extending in a longitudinal direction, an inclined extension part fastened to a lower surface or a side surface of the H-beam and inclined in such a way as to flare at an upper end thereof, a reinforcing part for reinforcing the inclined extension part, a deck placed on an upper end of the inclined extension part, and a concrete layer for filling a top of the inclined extension part, a top of the H-beam, and a top of the deck.

1 Claim, 13 Drawing Sheets

(56) References Cited

U.S. PATENT DOCUMENTS

| | | | | |
|---|---|---|---|---|
| 4,867,074 | A * | 9/1989 | Quasnick | 108/51.3 |
| 5,802,800 | A * | 9/1998 | Meyers | 52/847 |
| 6,058,673 | A * | 5/2000 | Wycech | 52/834 |
| 6,475,577 | B1 * | 11/2002 | Hopton et al. | 428/34.7 |
| 6,561,736 | B1 * | 5/2003 | Doleshal | 405/251 |
| 6,807,789 | B1 * | 10/2004 | Kim et al. | 52/847 |
| 7,383,665 | B2 * | 6/2008 | Frobosilo | 52/204.2 |
| 8,281,534 | B2 * | 10/2012 | Bae et al. | 52/414 |
| 2004/0093825 | A1 * | 5/2004 | Lee | 52/731.2 |
| 2007/0193194 | A1 * | 8/2007 | Smith | 52/702 |
| 2010/0031605 | A1 * | 2/2010 | Hong et al. | 52/839 |

* cited by examiner

SUPPORT BEAM STRUCTURE CAPABLE OF EXTENDING SPAN AND REDUCING HEIGHT OF CEILING STRUCTURE AND INSTALLING METHOD THEREOF

BACKGROUND OF THE INVENTION

1. Field of the Invention

The present invention relates generally to a support beam structure capable of extending a span and reducing a height of a ceiling structure and an installing method thereof and, more particularly, to a support beam structure capable of extending a span and reducing a height of a ceiling structure and an installing method thereof, which extends the span between pillars of a building to increase the efficiency of utilization of the building, and reduces the height of a ceiling structure of the building to increase the number of stories within the story height allowed by a specific locale, thus achieving a reduction in construction cost of the building and an increase in an available ceiling height of the building for the same number of stories, thereby maximizing space utilization of the building, and which increases an available area in the case of increasing the number of stories of the building, thus leading to an increase in profits in proportion to the increased area, and which allows components of the support beam structure to be manufactured of ready-made products that are easily purchasable, thus achieving a reduction in material cost and construction cost.

2. Description of the Related Art

Generally, with the progress being made in architecture, a structure, such as a house, supported by pillars or walls, and also a variety of supersized buildings having no pillars, for example, a performance facility, a public hall, an automated factory, an unmanned warehouse, a zoo, a botanical garden, an exhibition center, a hangar, a gym, a leisure facility, etc. are being built. Further, such buildings are being required.

With the appearance of the above-mentioned building, in order to create a better environmental space, research and development has been constantly made in various fields including research into advanced construction methods and technical development in civil engineering and construction and concrete material for the structural foundation.

A large space having no pillars advantageously maximizing the utilization of space. If pillars exist in a space, the space utilization is limited to the interval between the pillars. Some space around the pillars may be difficult to use.

However, the whole interior of a building which has a space having no pillars can be used. Further, this space has excellent adaptability to environmental change. When it is required to change facilities in a building because of a future change in the business environment, it is considerably difficult to place partition walls if there are pillars in the space. However, if there are no pillars, the partition wall may be freely placed, and the space may be adaptable to any change of building use.

Thus, owners of general buildings prefer a long span building that has pillars separated by a long distance. However, the long span building is problematic in that the thickness of a support beam forming a framework of the building increases as the span increases, so that the height of a ceiling structure increases, a story height of the building increases, and thereby the construction cost of the building increases exponentially. Meanwhile, in the case of a region having a height limit that applies to buildings, it is impossible to provide a desired number of stories to the building, so that profitability decreases remarkably, and besides, construction cost of the building undesirably increases.

As shown in FIG. 1, a modern building is constructed so that a support beam 91 is placed between support pillars 90 standing upright, and a duct 92 and electric wiring 93 or other equipment pass through a lower end of the support beam 91. In the case of requiring a long span, a stronger and higher support beam 91 is used. Further, an additional space must be provided on a lower surface of the support beam 91 to permit the passage of the duct 92 and electric wiring 93 or other equipment, and a ceiling finishing surface 94 must be provided on the lower end of the support beam 91. Thus, the ceiling structure of the building requires a large thickness and the story height of the building must be increased. This overlaps with the above-mentioned problem wherein the number of stories of the building is reduced and space utilization is considerably reduced.

SUMMARY OF THE INVENTION

Accordingly, the present invention has been made keeping in mind the above problems occurring in the prior art, and an object of the present invention is to provide a support beam structure capable of extending a span and reducing a height of a ceiling structure and an installing method thereof, which can extend a span, namely, a distance between pillars of a building to enhance space utilization, thus improving utilization of the building, and which can reduce a height of a support beam installed between the pillars to reduce construction cost, and which allows a duct or electric wiring to be installed between support beams, thus enabling a ceiling finishing surface to be directly provided on a lower end of the support beam, thereby achieving a reduction in the story height of a building, therefore allowing a building to have a greater number of stories or allowing the height of each story to be increased for the same number of stories, and thereby enabling pleasant use of a building.

In order to accomplish the above object, the present invention provides a support beam structure capable of extending a span and reducing a height of a ceiling structure, the support beam structure including: an H-beam extending in a longitudinal direction, an inclined extension part fastened to a lower surface or a side surface of the H-beam and inclined in such a way as to flare at an upper end thereof, a reinforcing part for reinforcing the inclined extension part, a deck placed on an upper end of the inclined extension part, and a concrete layer filling the deck placed on the upper end of the inclined extension part.

The support beam structure capable of extending a span and reducing a height of a ceiling structure and the installing method thereof according to the present invention is advantageous in that it can extend a span, namely, a distance between pillars of a building to enhance space utilization, thus improving utilization of the building, and it can reduce a height of a support beam installed between the pillars to reduce construction cost, and it allows a duct or electric wiring to be installed between support beams, thus enabling a ceiling finishing surface to be directly provided on a lower end of the support beam, thereby achieving a reduction in the story height of a building, therefore allowing a building to have a greater number of stories or allowing the height of each story to be increased for the same number of stories, and thereby enabling pleasant use of a building.

BRIEF DESCRIPTION OF THE DRAWINGS

The above and other objects, features and advantages of the present invention will be more clearly understood from the following detailed description taken in conjunction with the accompanying drawings, in which:

FIGS. 2A, 2B, 2C and 2D show a support beam structure according to a first embodiment of the present invention, in which FIG. 2A is an exploded perspective view, FIG. 2B is a vertical sectional view, and FIG. 2C is a vertical section view when a duct is installed;

FIGS. 7A, 7B, and 7C show a support beam structure according to a seventh embodiment of the present invention, in which FIGS. 7A and 7B are a perspective view and a vertical sectional view of the support beam structure, and FIG. 7C is a front view of a reinforcing part;

DESCRIPTION OF THE PREFERRED EMBODIMENTS

Figure 1:
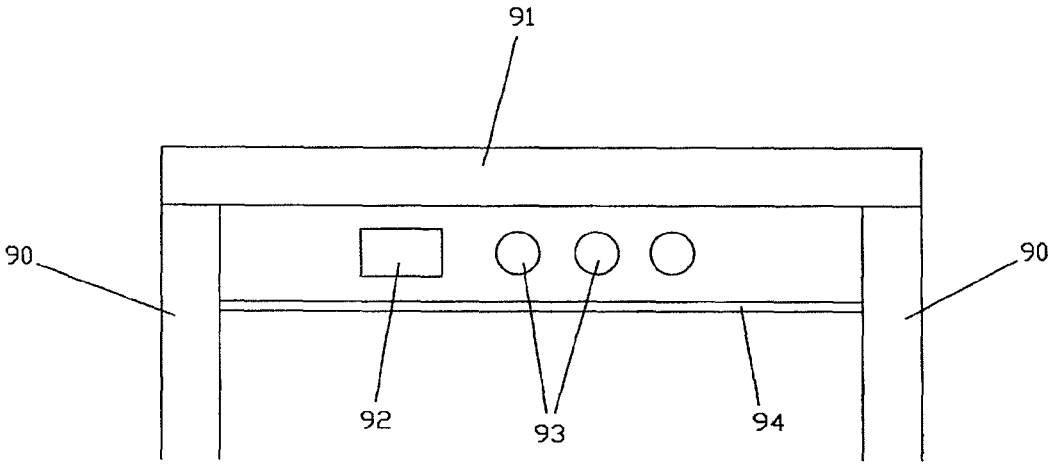
FIG. 1 is a schematic vertical sectional view showing a conventional support beam structure.
Figure 2A:
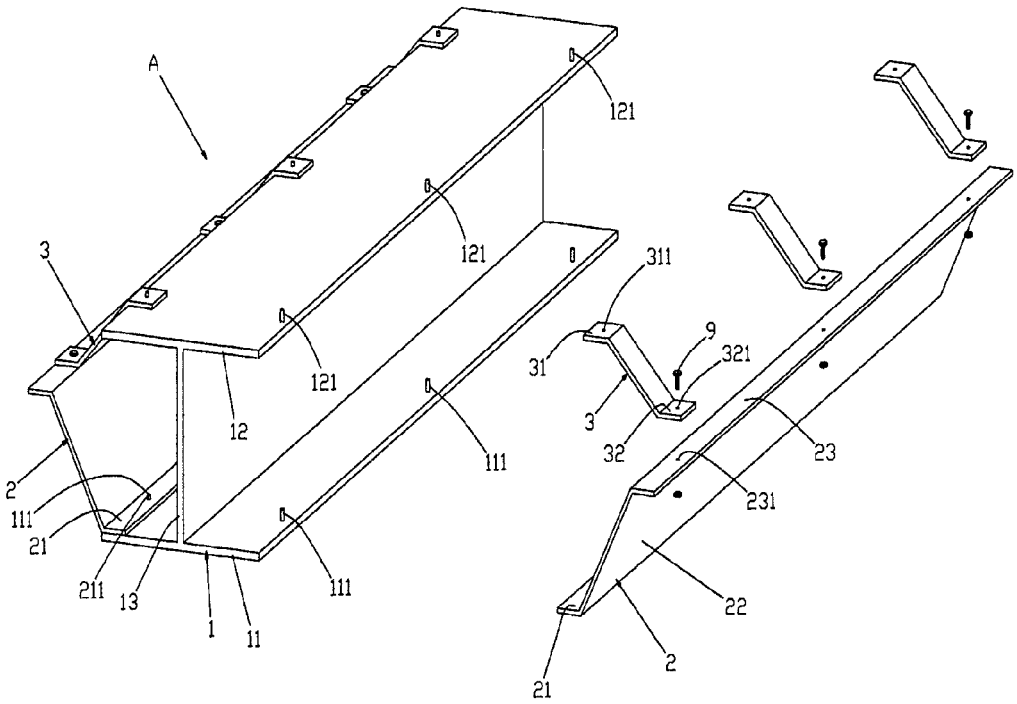
Figure 2B:
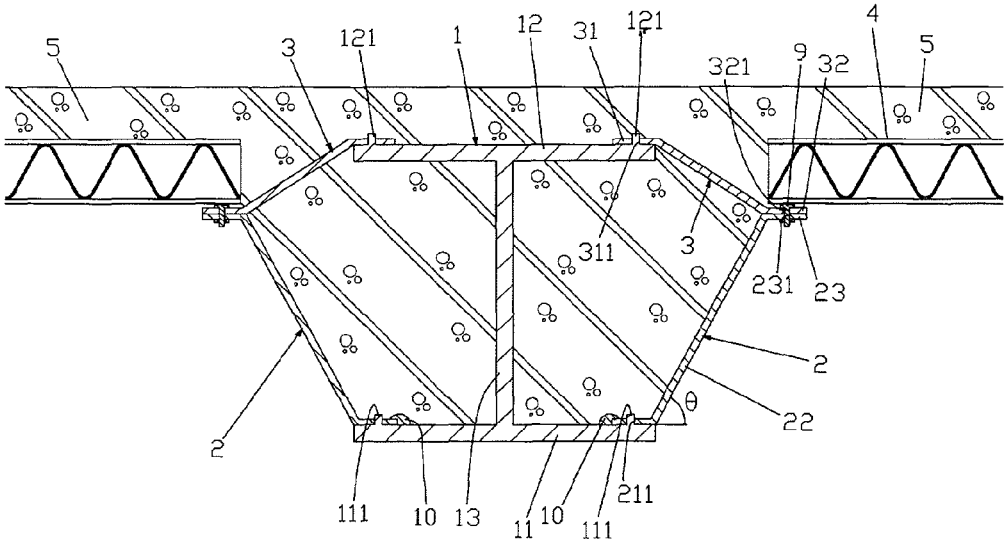
Figure 2C:
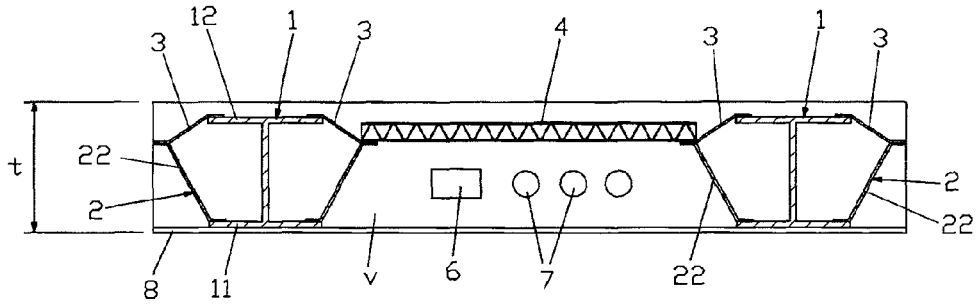
Figure 2D:
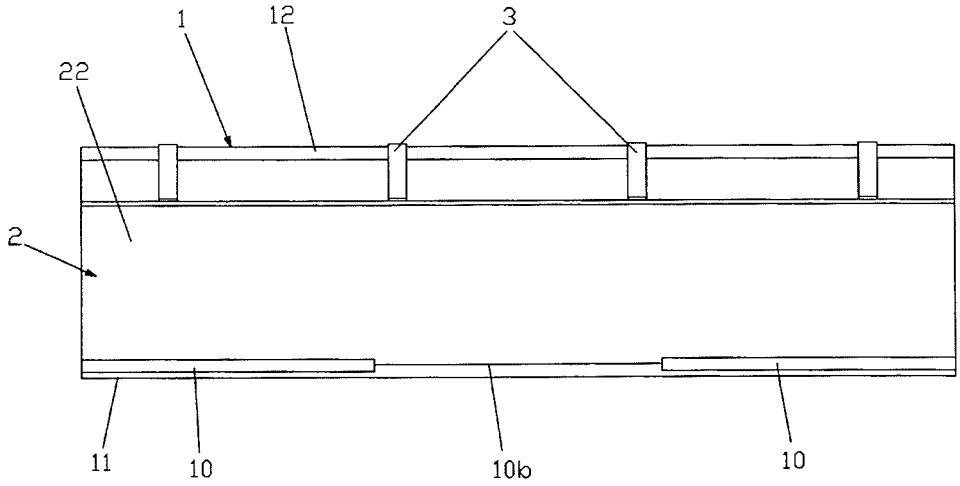

A method of installing a support beam structure according to the present invention includes a step of installing an H-beam that extends in a longitudinal direction and has assembly parts formed on ends of upper and lower horizontal flanges to be spaced apart from each other, a step of coupling an inclined extension part to the assembly part provided on a lower portion of the H-beam, using an assembly part that is coupled at a lower end thereof to the assembly part of the lower horizontal flange of the installed H-beam, a step of assembling a reinforcing part to couple the inclined extension part with the H-beam and thereby reinforce the inclined extension part, using an assembly part that is fastened at opposite ends thereof to an upper assembly part of the inclined extension part and the assembly part of the upper horizontal flange of the H-beam, a step of placing a deck on an upper end of the inclined extension part, and a step of welding coupling portions between the inclined extension part and the H-beam, at a position on the deck.

As shown in FIGS. 2A to 2D, a support beam structure A capable of extending the span and reducing the height of a ceiling structure according to a first embodiment of the present invention includes an H-beam 1, an inclined extension part 2, a reinforcing part 3, a deck 4, and a concrete layer 5. The H-beam 1 extends in a longitudinal direction, so that a wide surface is disposed thereon. The inclined extension part 2 is fastened to a lower surface of the H-beam 1 and inclined in such a way as to flare at an upper end thereof. The reinforcing part 3 functions to reinforce the inclined extension part 2. The deck 4 is placed on an upper end of the inclined extension part 2. The concrete layer 5 fills the deck 4 placed on the upper end of the inclined extension part 2.

A duct 6 or a pipe 7 for electric wiring is installed in a space V outside neighboring inclined surfaces 22 of inclined extension parts 2, which are adjacent to but spaced apart from each other. A ceiling finishing panel 8 is disposed right under a lower horizontal flange 11 of the H-beam 1. As a result, the space V for accommodating a duct 6 or electric wiring pipe 7 is formed on a side of the H-beam 1, so that the height for the duct 6 or the electric wiring pipe 7 is reduced, and thereby the height of the ceiling structure can be reduced.

The H-beam 1 according to the first embodiment of the present invention has a height of about 300 mm when a span is 10 m. As compared with the conventional H-beam 1 having a height of about 650 to 680 mm, the height of the H-beam of this invention can be reduced by almost half.

The reason why the height of the H-beam 1 of this invention can be considerably reduced is as follows. That is, the support beam structure A of this invention is configured so that it does not use only the H-beam 1, the inclined extension part 2 is fastened to the lower surface of the H-beam 1, the reinforcing part 3 is coupled to a top of the inclined extension part 2 and a top of the H-beam 1, and the concrete layer 5 is cured above the inclined extension part 2. Hence, overall strength of the support beam structure A increases. Thereby, even though a span between pillars is increased to 10 m, the height of the H-beam 1 can be considerably reduced.

Since such an H-beam 1 may be manufactured using a steel-frame beam that is easily purchasable in the market, the H-beam 1 is inexpensive and thus a reduction in material cost is achieved. The H-beam 1 includes a vertical web 13 and upper and lower horizontal flanges 12 and 11.

The reinforcing part 3 is fastened at opposite ends thereof to the upper horizontal flange 12 of the H-beam 1 and an upper fastening bracket 23 of the inclined extension part 2, thus preventing the inclined extension part 2 from sagging downwards. The reinforcing part 3 is formed of a flat plate material or a reinforcing bar material, and is horizontally bent at opposite ends thereof to form horizontal fastening portions 31 and 32 that are fastened to the H-beam 1 and the inclined extension part 2.

The reinforcing part 3 includes an assembly part 311 on the horizontal fastening portion 31 formed on one end thereof, so that an assembly part 121 formed on the upper horizontal flange 12 of the H-beam 1 is securely fitted into the assembly part 311 that has a shape corresponding to that of the assembly part 121. Further, an assembly part 321 is provided on the horizontal fastening portion 32 formed on the other end of the reinforcing part 3, and has a shape corresponding to that of an assembly part 231 provided on the upper fastening bracket 23 of the inclined extension part 2 to be coupled with the assembly part 231.

In this embodiment, the assembly parts 311 and 321 of the reinforcing part 3 comprise assembly holes to be coupled with the assembly part 231 of the inclined extension part 2 and the assembly part 121 of the upper horizontal flange 12 of the H-beam 1. However, the shape of the assembly parts 311 and 321 may be naturally changed without being limited to the assembly holes, as long as the shape of the assembly parts 311 and 321 corresponds to that of the assembly parts 121 and 231.

According to this embodiment, the assembly part 231 of the inclined extension part 2 and the assembly part 321 of the reinforcing part 3 are coupled with each other via a fastening means 9 including a bolt and a nut.

As such, after inclined extension parts 2 and reinforcing parts 3 are coupled to opposite sides of the H-beam 1 via the assembly parts, the deck 4 is disposed on the upper fastening bracket 23 of the inclined extension part 2. Thereby, after the deck 4 of a wide area is stably installed, a welding process can be comfortably performed without the danger of falling. Thus, when a worker comfortably welds contact portions between the lower horizontal flange 11 of the H-beam 1 and a lower fastening bracket 21 of the inclined extension part 2 to form a welded portion 10, the installation of the assemblable support beam structure A has been completed. That is, if a non-welded portion 10*b* is formed in the middle of the contact portions between the lower horizontal flange 11 of the H-beam 1 and the lower fastening bracket 21 of the inclined extension part 2 without completely welding the contact portions, water can be easily discharged through the non-welded portion 10*b* during concrete casing.

Figure 3:
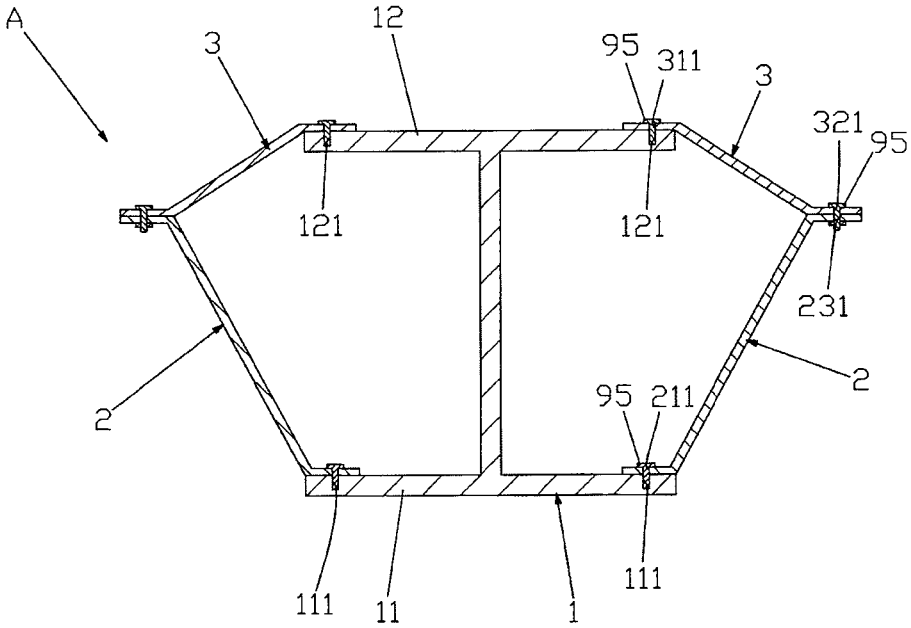
FIG. 3 is a vertical sectional view showing a support beam structure according to a second embodiment of the present invention.

FIG. 3 shows a support beam structure A according to a second embodiment of the present invention, in which an assembling configuration of an H-beam 1, an inclined extension part 2, and a reinforcing part 3 is different from that of the first embodiment. Upper and lower horizontal flanges 12 and 11 of the H-beam 1 have assembly holes as assembly parts 121 and 111, and the inclined extension part 2 has assembly holes on assembly parts 211 and 231. Further, assembly holes are formed on assembly parts 311 and 321 of the reinforcing part 3. Thereby, an assembling operation is carried out by fitting assembly screws 95 into the assembly holes.

Figure 4A:
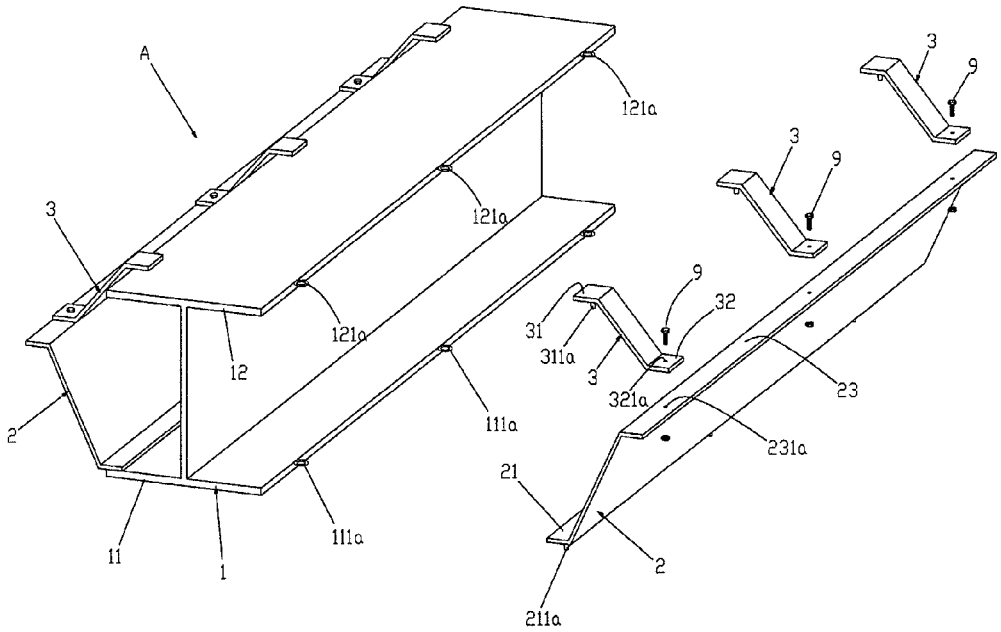
FIGS. 4A and 4B are an exploded perspective view and a vertical sectional view showing a support beam structure according to a third embodiment of the present invention.
Figure 4B:
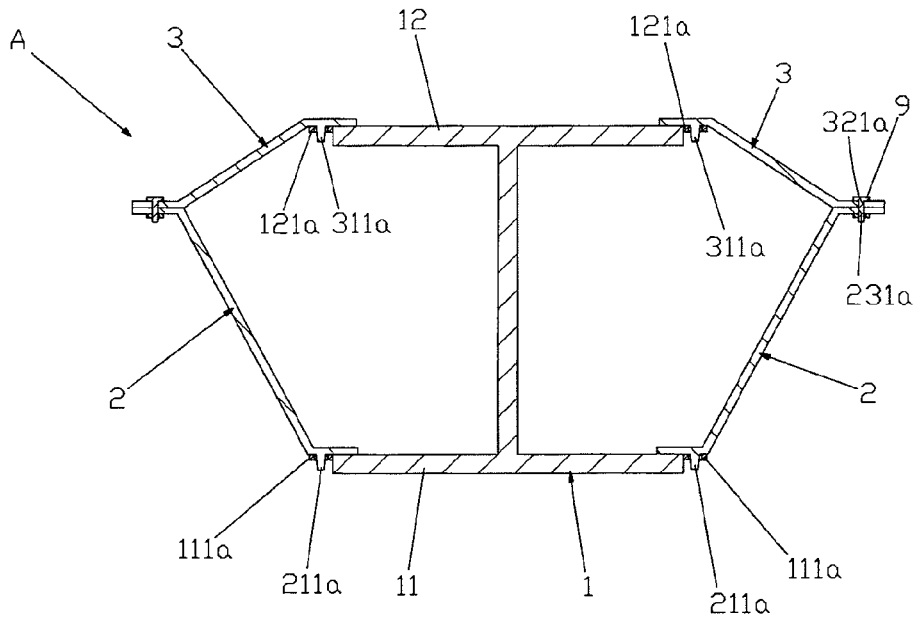

FIGS. 4A and 4B show a support beam structure A according to a third embodiment of the present invention. According to this embodiment, upper and lower horizontal flanges 12 and 11 of an H-beam 1 include assembly rings 121*a* and 111*a* as assembly parts 121 and 111. An inclined extension part 2 has an assembly pin 211*a* as a lower assembly part 211, and has an assembly hole 231*a* as an upper assembly part 231. A reinforcing part 3 has an assembly pin 311*a* as an assembly part 311, and has an assembly hole 321*a* as an assembly part 321. An upper fastening bracket 23 of the inclined extension part 2 is connected to a lower horizontal fastening portion 32 of the reinforcing part 3 by connecting the assembly part 231 to the assembly part 321 and fitting a fastening means 9 including a bolt and a nut into the connected assembly parts.

Figure 5A:
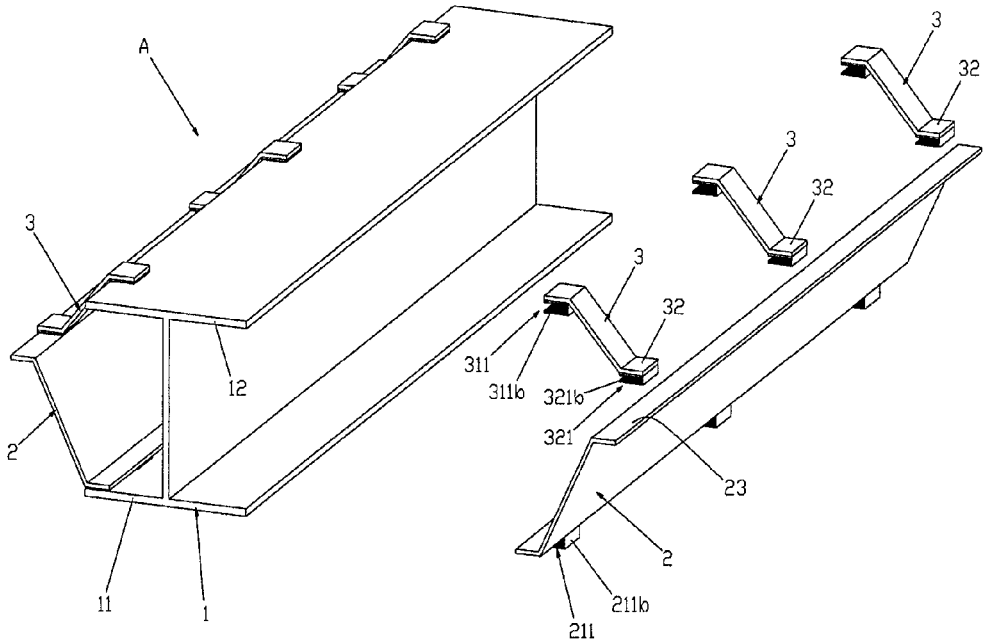
FIGS. 5A and 5B are an exploded perspective view and a vertical sectional view showing a support beam structure according to a fourth embodiment of the present invention.
Figure 5B:
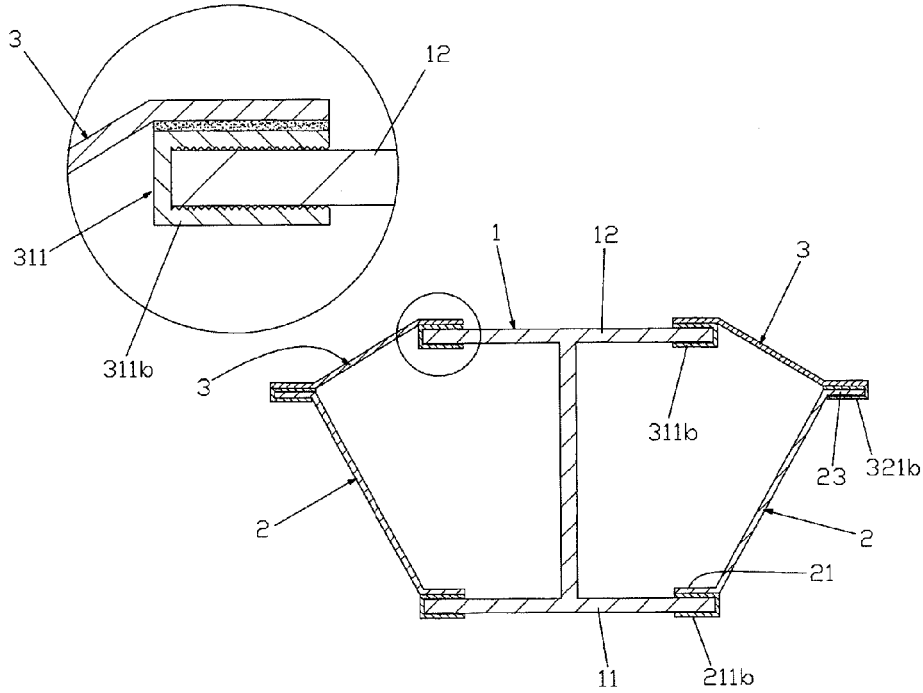

FIGS. 5A and 5B show a support beam structure A according to a fourth embodiment of the present invention. According to this embodiment, assembly parts 211 and 311 that are to be coupled to ends of upper and lower horizontal flanges 12 and 11 of an H-beam 1 are provided, respectively, on an end of an inclined extension part 2 and an end of a reinforcing part 3. An upper fastening bracket 23 of the inclined extension part 2 is connected to a lower horizontal fastening portion 32 of the reinforcing part 3 by surrounding the upper fastening bracket 23 with the assembly part 321 of the horizontal fastening portion 32. The assembly parts 211, 311 and 321 comprise surrounding parts 211*b*, 311*b* and 321*b* in such a way as to be fitted over corresponding parts.

Assembly parts 211 are formed to be spaced apart from each other at regular intervals in a longitudinal direction of the inclined extension part 2, so that the assembly parts 211 are securely fitted over the lower horizontal flange 11 of the H-beam 1. The upper assembly part 311 of the reinforcing part 3 is securely fitted over the upper horizontal flange 12 of the H-beam 1. Further, the upper fastening bracket 23 of the inclined extension part 2 is surrounded by the assembly part 321 formed on the horizontal fastening portion 32 of the reinforcing part 3.

Figure 6A:
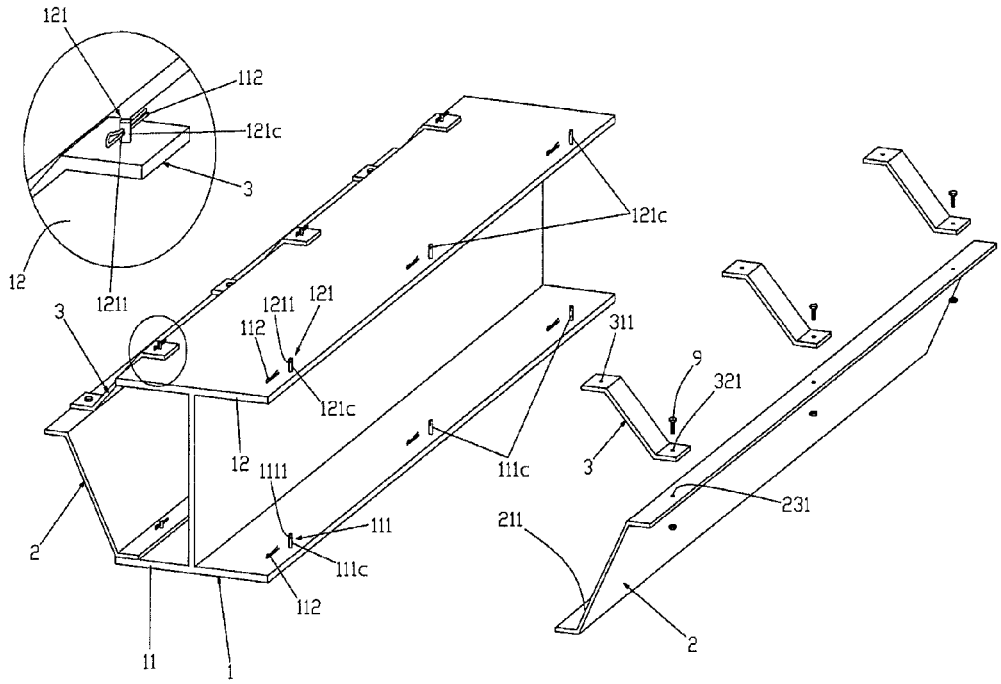
FIGS. 6A and 6B are exploded perspective views showing support beam structures according to fifth and sixth embodiments of the present invention, respectively.

FIG. 6A shows a support beam structure A according to a fifth embodiment of the present invention. Horizontal flanges 11 and 12 of an H-beam 1 include protruding pins 111*c* and 121*c* as assembly parts 111 and 121, with through holes 1111 and 1211 being formed through the protruding pins 111*c* and 121*c* to permit passage of wires 112. An inclined extension part 2 includes an assembly part 211, so that an assembly part 111 of the lower horizontal flange 11 is fitted into the assembly part 211 and then is fastened by the wire 112, and thereby the inclined extension part 2 is fastened to the lower horizontal flange 11. The inclined extension part 2 has on an upper end thereof an assembly part 231, so that a lower assembly part 321 of the reinforcing part 3 is fastened to the assembly part 231 via a fastening means 9 including a bolt and a nut. The reinforcing part 3 includes on an upper end thereof an assembly part 311, so that the assembly part 121 of the upper horizontal flange 12 of the H-beam 1 is fitted into the assembly part 311 and then is fastened by the wire 112.

Figure 6B:
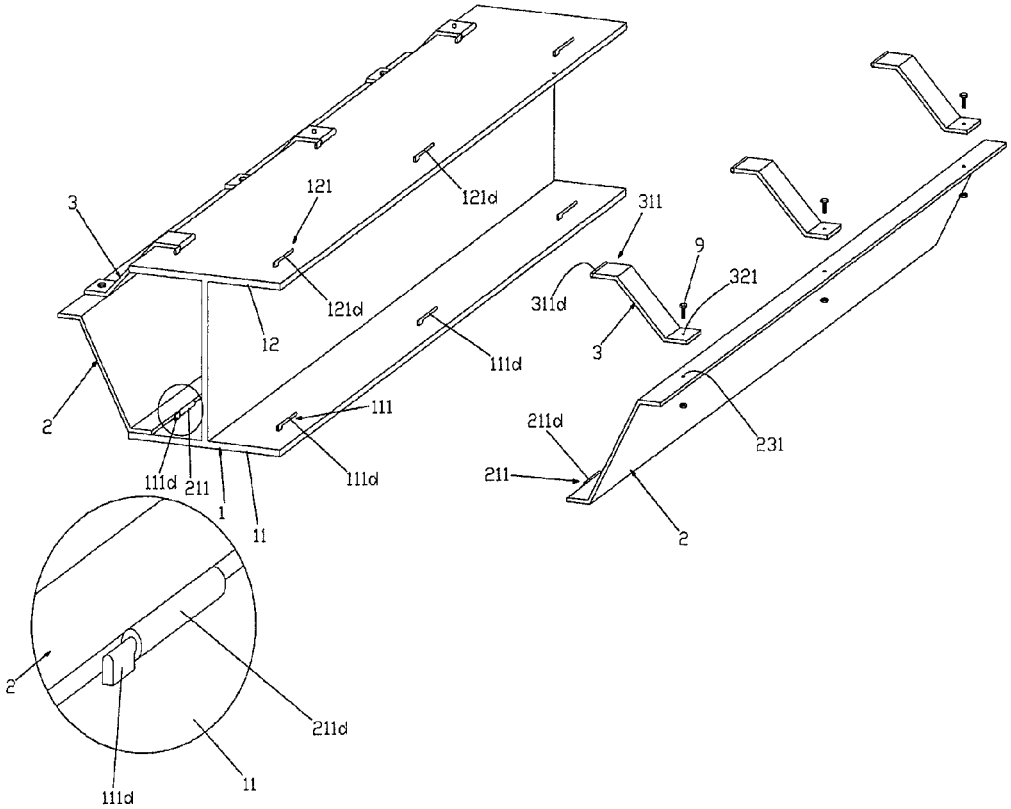

FIG. 6B shows a support beam structure A according to a sixth embodiment of the present invention. According to this embodiment, assembly parts 111 and 121 formed on horizontal flanges 11 and 12 of an H-beam 1 comprise 'L'-shaped bent pins 111*d* and 121*d*. An assembly part 211 of an inclined extension part 2 comprises an assembly pipe 211*d* to correspond to the assembly part 111, so that the assembly part 111 of the lower horizontal flange 11 is securely fitted into the assembly part 211. The inclined extension part 2 has on an upper end thereof an assembly part 231, so that a lower assembly part 321 of a reinforcing part 3 is fastened to the assembly part 231 via a fastening means 9 including a bolt and a nut. The reinforcing part 3 has on an upper end thereof an assembly part 311. The assembly part 311 comprises an assembly pipe 311*d* corresponding to the assembly part 121, so that the assembly part 121 of the upper horizontal flange 12 of the H-beam 1 is securely fitted into the assembly part 311.

Figure 7A:
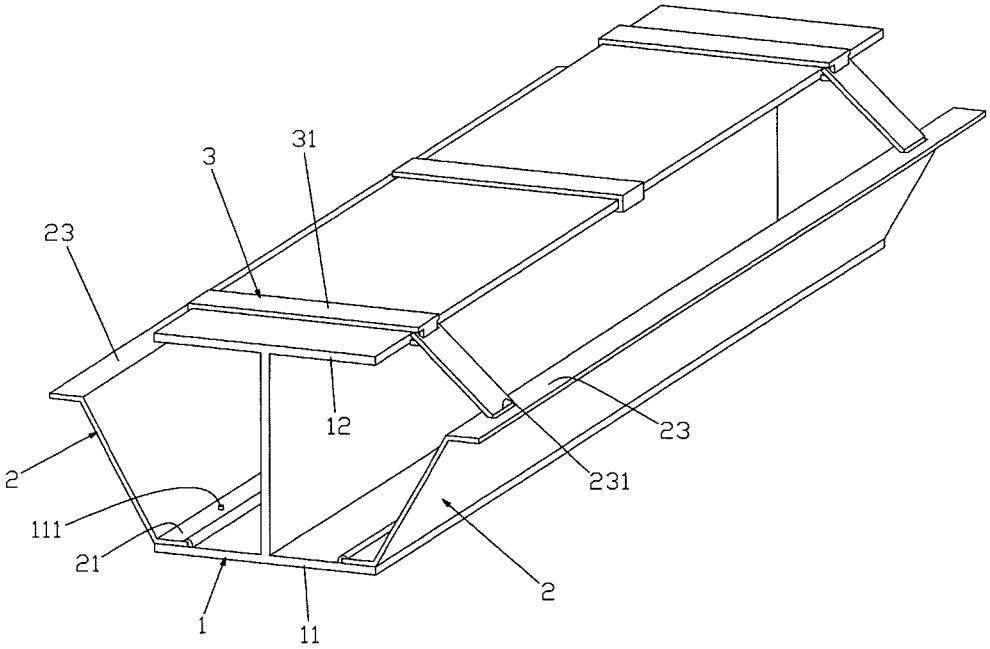
Figure 7B:
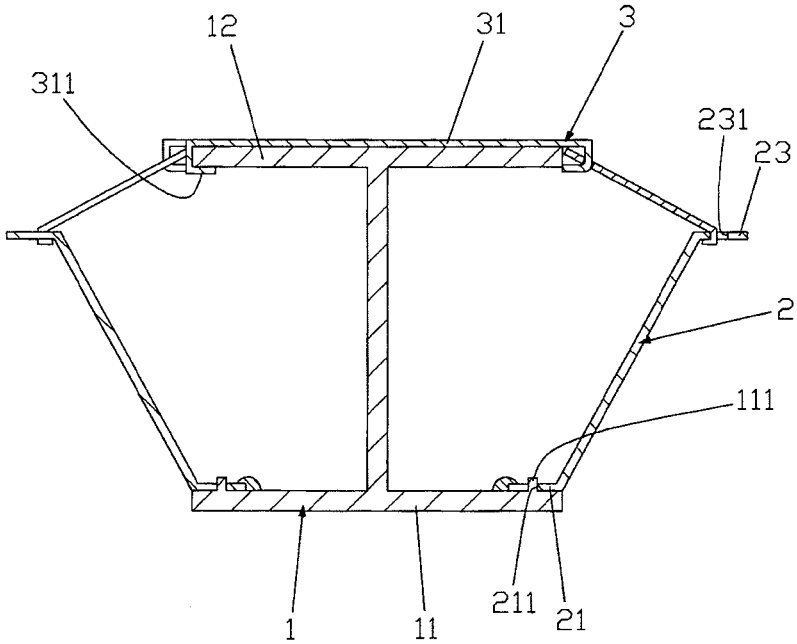
Figure 7C:
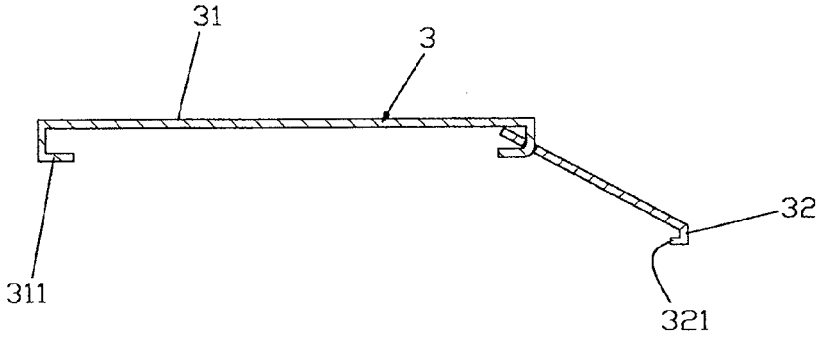

FIGS. 7A, 7B and 7C show a support beam structure according to a seventh embodiment of the present invention, in which FIGS. 7A and 7B are a perspective view and a vertical sectional view of the support beam structure, respectively, and FIG. 7C is a front view of a reinforcing part. According to this embodiment, an assembly part 111 of a lower horizontal flange 11 of an H-beam 1 is coupled to an assembly part 211 of a lower fastening bracket 21 of an inclined extension part 2, and an assembly part 231 is provided on an upper fastening bracket 23 of the inclined extension part 2. Further, a horizontal fastening portion 31 provided on an upper end of a reinforcing part 3 extends to form a bent assembly part 311 that is caught by a side of an upper horizontal flange 12 of the H-beam 1, and a fastening portion 32 provided on a lower end of the reinforcing part 3 includes a bent assembly part 321 that has a shape corresponding to that of the assembly part 231 to be coupled with the assembly part 231 of the upper fastening bracket 23 of the inclined extension part 2. The reinforcing part 3 is divided into two portions for the purpose of easy operation. Thus, this embodiment allows the reinforcing part 3 to be collected and reused, after the inclined extension part 2 is welded to the H-beam 1.

Figure 8:
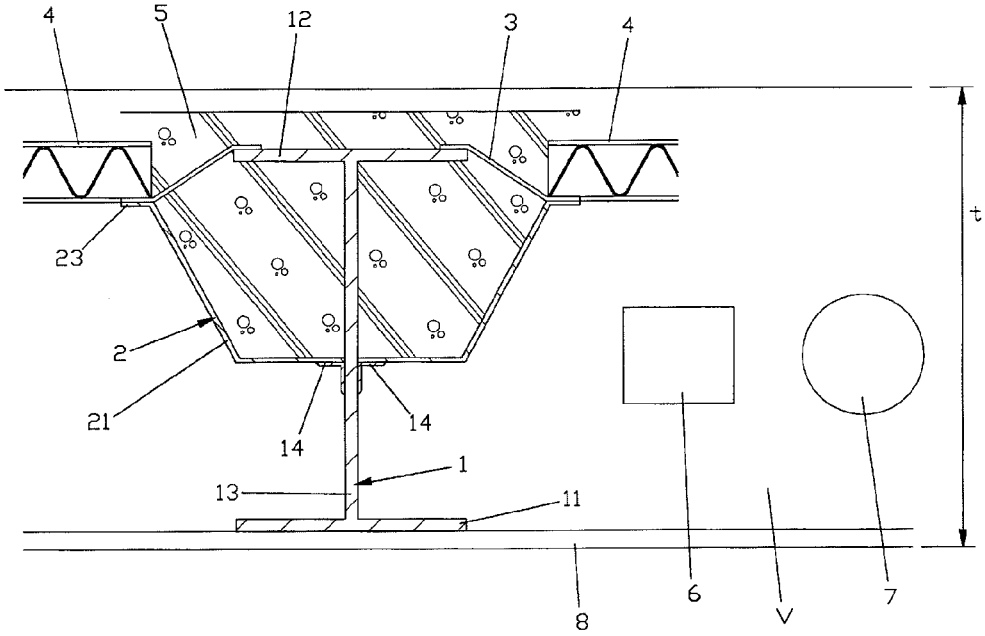
FIG. 8 is a vertical sectional view showing a support beam structure according to an eighth embodiment of the present invention.

Further, as shown in FIG. 8, a support beam structure A capable of extending the span and reducing the height of a ceiling structure according to an eighth embodiment of the present invention includes an H-beam 1, an inclined extension part 2, a reinforcing part 3, a deck 4, and a concrete layer 5. The H-beam 1 extends in a longitudinal direction. The inclined extension part 2 is secured to the vertical web 13 of the H-beam 1, and is inclined to flare at an upper end thereof. The reinforcing part 3 functions to reinforce the inclined extension part 2. The deck 4 is placed on the inclined extension part 2. The concrete layer 5 fills the deck 4 placed on the inclined extension part 2. In this case, an 'L'-shaped angle 14 is used to support a bottom of the inclined extension part 2 and the vertical web 13. In this embodiment, the 'L'-shaped angle is used. However, the inclined extension part 2 and the vertical web 13 may be supported by general welding or reinforcing bar welding without being limited to the 'L'-shaped angle.

A ceiling finishing panel 8 is disposed under a lower horizontal flange 11 of the H-beam 1 to be spaced apart therefrom by a predetermined distance, and a duct 6 or an electric wiring pipe 7 may be provided in a space V above the ceiling finishing panel 8. According to this embodiment, it is possible to install a great number of ducts 6 or electric wiring pipes 7.

The support beam structure A capable of extending the span and reducing the height of the ceiling structure according to the present invention is configured so that the deck 4 is disposed on an upper fastening bracket 23 of the inclined extension part 2 and the concrete layer 5 is placed on the deck 4, thus increasing strength of the support beam structure A. Thereby, the support beam structure may be applied to a long span with the small H-beam 1, thus enhancing space utilization. The H-beam 1 of the support beam structure A has on a side thereof a space that permits passage of the duct 6 or the electric wiring pipe 7, and the ceiling finishing panel 8 is provided right under the H-beam 1. Thereby, a thickness t of the ceiling structure is reduced, so that the number of stories of a building can be increased within a limited height.

Figure 9:
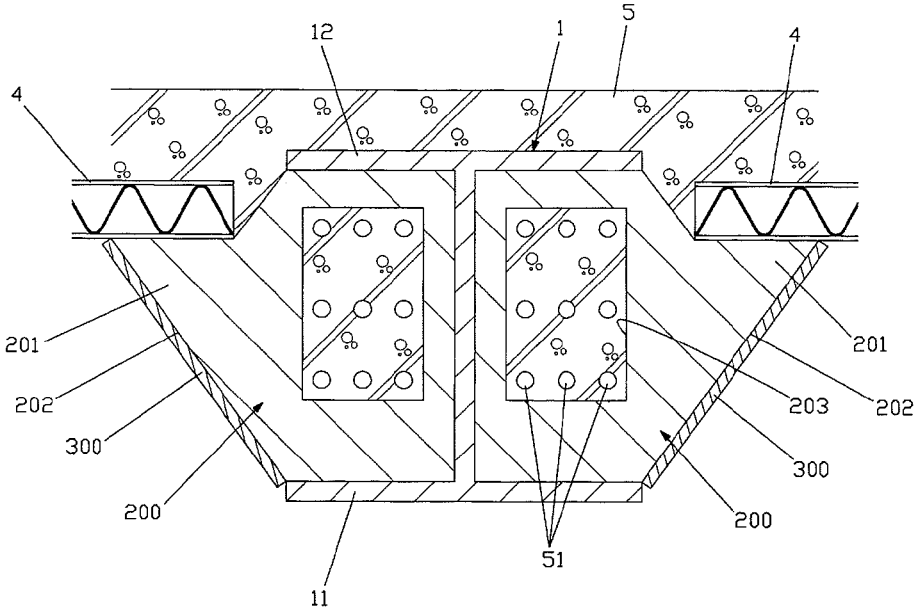
FIG. 9 is a vertical sectional view showing a support beam structure according to a ninth embodiment of the present invention.

FIG. 9 shows a support beam structure A capable of extending the span and reducing the height of a ceiling structure according to a ninth embodiment of the present invention. The support beam structure A includes an H-beam 1, a plurality of reinforcing plates 200, an inclined plate 300, a deck 4, and a concrete layer 5. The H-beam 1 extends in a longitudinal direction, so that a wide surface is disposed thereon. The reinforcing plates 200 are securely inserted between upper and lower horizontal flanges 12 and 11 of the H-beam 1 in such a way as to be spaced apart from each other at regular intervals. An extension protruding part 201 is provided on a side of the reinforcing plate 200 to place the deck 4 thereon. The inclined plate 300 is attached to a lower inclined surface 202 of the extension protruding part 201 of the reinforcing plate 200. The deck 4 is placed on the extension protruding part 201 of the reinforcing plate 200. The concrete layer 5 is placed on the deck 4 of the extension protruding part 201 provided on the side of the reinforcing plate 200.

The H-beam 1 according to the ninth embodiment of the present invention has a height of about 300 mm when a span is 10 m. As compared with the conventional H-beam 1 having a height of about 650 to 680 mm, the height of the H-beam of this invention can be reduced by almost half.

The reason why the height of the H-beam 1 of this invention can be considerably reduced is as follows. That is, the support beam structure A of this invention is configured so that it does not use only the H-beam 1, and the plurality of reinforcing plates 200 are inserted between the upper and lower horizontal flanges 12 and 11 in such a way as to be spaced apart from each other at an interval of 2 m, thus increasing strength of the H-beam 1, and the concrete layer 5 is cured on the reinforcing plate 200, thus increasing overall strength of the support beam structure A. Thereby, even though a span between pillars is increased to 10 m, the height of the H-beam 1 can be considerably reduced.

In this embodiment, an installation interval between the reinforcing plates 200 is 2 m. However, the interval may be increased or reduced as necessary.

According to this embodiment, the thickness of the reinforcing plate 200 is 5 mm, one side of the reinforcing plate 200 inserted into the H-beam 1 has the shape of a flat rectangle and is securely inserted between the upper and lower horizontal flanges 12 and 11 of the H-beam 1, the other side of the reinforcing plate 200 on which the deck 4 is placed protrudes so that the extension protruding part 201 can be installed, and a lower portion of the reinforcing plate 200 coupled to the extension protruding part 201 has the inclined surface 202. Thus, the reinforcing plate 2 is fastened in the H-beam 1 using a hitting means such as a hammer, so that the fastening operation is very easy.

Figure 10:
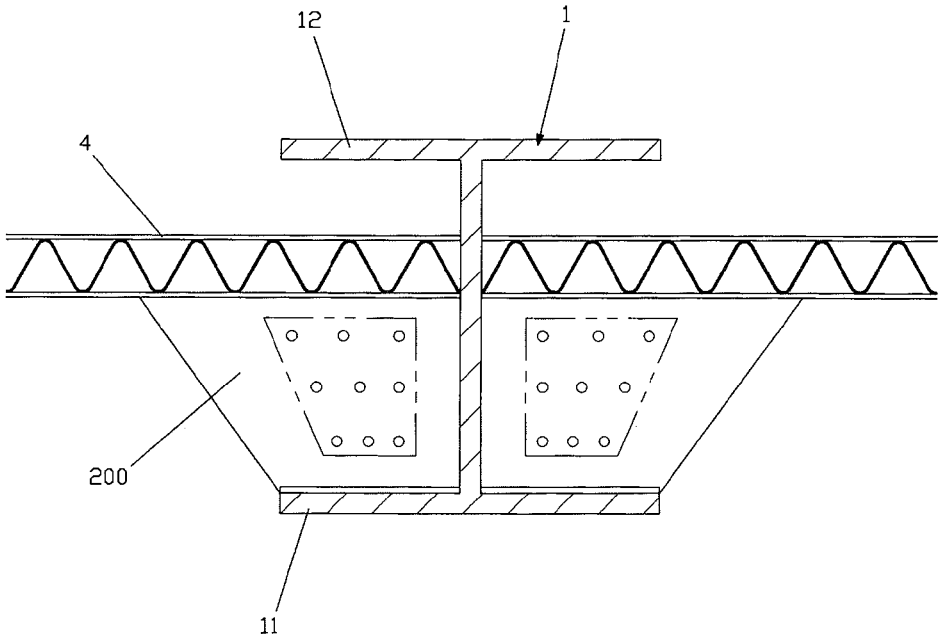
FIG. 10 is a vertical sectional view showing a support beam structure according to a tenth embodiment of the present invention.

In this embodiment, the reinforcing plate 200 has on one side the extension protruding part 201 and the inclined surface 202. However, without being limited to such a configuration, a through hole 203 for permitting passage of a reinforcing bar 51 and concrete may be formed in a central portion of the reinforcing plate 200 as shown in FIGS. 9 and 10. Further, as shown in FIG. 10, a reinforcing plate may be welded to a lower horizontal flange 11 of an H-beam 1, and an upper end of the reinforcing plate may be spaced apart from an upper horizontal flange 12 by a predetermined distance to form a space, so that a deck 4 may be inserted into the space. Such a configuration does not require the inclined plate 300.

As described above, the present invention provides a support beam structure capable of extending the span and reducing the height of a ceiling structure and an installation method thereof, in which the support beam structure is manufactured by cutting, bending, and welding an H-beam or a steel sheet produced in a general manufacturing plant, and is manufactured to permit repeated production, so that this invention has industrial applicability.

What is claimed is:

1. A support beam structure capable of extending a span and reducing a height of a ceiling structure, the support beam structure comprising:

an H-beam extending in a longitudinal direction;

a plurality of reinforcing plates inserted between the upper and lower horizontal flanges of the H-beam in such a way as to be spaced apart from each other at regular intervals, with an extension protruding part being provided on a side of each of the reinforcing plates to place a deck thereon;

an inclined plate fastened to a lower inclined surface of the extension protruding part of each of the reinforcing plates;

the deck placed on the extension protruding part of each of the reinforcing plates; and a concrete layer for filling a top of the inclined plate and a top of the deck, wherein each of the reinforeing plates is configured so that a first side surface thereof inserted into the H-beam has a shape of a flat rectangle and is securely inserted between the upper and lower horizontal flanges of the H-beam, and a second side surface thereof having the deck protrudes to allow the extension protruding part to be placed thereon, and a lower portion thereof coupled to the extension protruding part has an inclined surface.

* * * * *